United States Patent [19]

Louviot

[11] 4,089,251

[45] May 16, 1978

[54] DEVICE FOR ACCELERATING THE INITIAL STROKE OF HYDRAULIC JACKS

[75] Inventor: Jean François Louviot, Boulogne Billancourt, France

[73] Assignee: Regie Nationale des Usines Renault, Boulogne Billancourt, France

[21] Appl. No.: 710,325

[22] Filed: Jul. 30, 1976

[30] Foreign Application Priority Data

Aug. 1, 1975 France ..... 75 24185

[51] Int. Cl.[2] ..... F15B 15/22

[52] U.S. Cl. ..... 91/26; 91/29; 91/408

[58] Field of Search ..... 91/408, 407, 409, 26

[56] References Cited

U.S. PATENT DOCUMENTS

| | | | |
|---|---|---|---|
| 2,060 | 8/1865 | Barrett | 91/26 |
| 3,033,169 | 5/1962 | Norwood | 91/26 |
| 3,138,066 | 6/1964 | Walker | 91/408 |
| 3,388,634 | 6/1968 | Madland | 91/408 |
| 3,592,106 | 7/1971 | Baughman | 91/409 |
| 3,626,812 | 12/1971 | Trick | 91/408 |

*Primary Examiner*—Paul E. Maslousky

*Attorney, Agent, or Firm*—Fleit & Jacobson

[57] ABSTRACT

A device for accelerating the initial stroke of hydraulic jacks, comprising a cylinder, a piston provided with sealing-rings, said cylinder fluid feed-orifices and orifices for exhausting fluid through a plurality of calibrated ports arranged in rows in the cylinder periphery at both ends thereof, characterized in that at least one piston-ring ($S_2$, $S_4$) at one end of piston (P) is mounted in its respective groove ($R_1$) with a certain amount of axial and lateral clearance, said groove communicating with the bottom of the piston through at least one port ($B_1$).

2 Claims, 3 Drawing Figures

Figures 1, 2, 3:
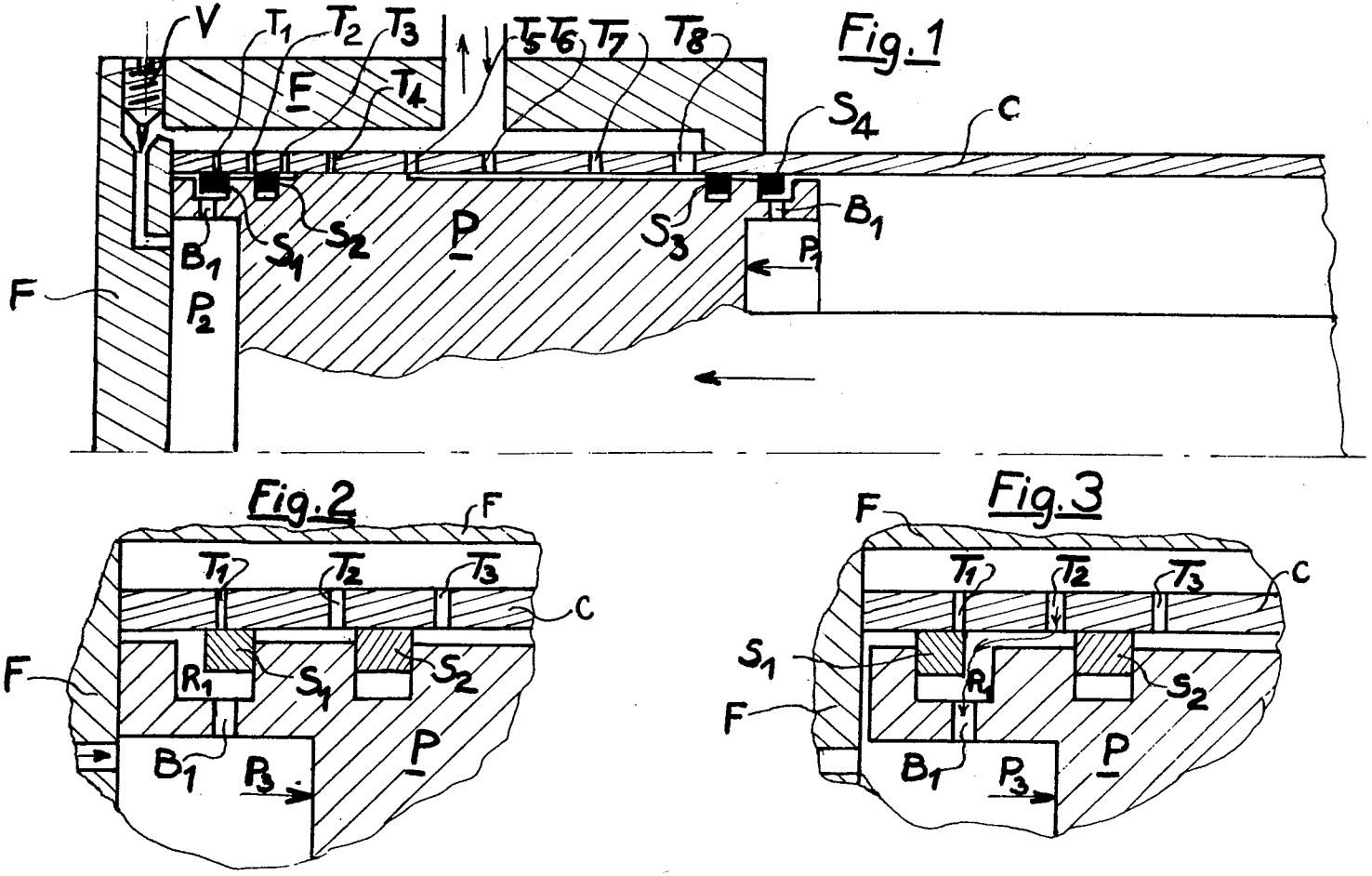

C
F
V
$T_1$
$T_2$
$T_3$
$T_4$
$T_5$
$T_6$
$T_7$
$T_8$
$S_1$
$S_2$
$S_3$
$S_4$
$B_1$
$R_1$
$P_1$
$P_2$
$P_3$

DEVICE FOR ACCELERATING THE INITIAL STROKE OF HYDRAULIC JACKS

The present invention relates to devices for accelerating the initial stroke of hydraulic jacks or cylinder assemblies.

Devices of that type are known in the prior art, in particular a device disclosed in French Pat. No. 73-33739 in the name of the Applicant, constituted by a pick-up valve acting as a non-return flap-valve, either adjustable or not, adapted to contribute to the filling of damping spaces.

Such spaces are constituted either by a portion of the jack-section, or by the whole jack-section. They can be filled, in particular, through ports, or orifices, made in the jack chamber periphery.

During the accelerating step, the piston uncovers those ports, and can thus be accelerated according to the changes in the flow cross-sections which cause the operatingfluid flow-rate to increase.

The ports are used both for accelerating and decelerating during the reverse motion, and they are designed for decelerating at a pressure above control pressure.

The most satisfactory solution would be similar acceleration and deceleration valves; however, the flow-rate of the ports varies according to the pressure applied to the operating fluid, and the control pressure is lower than checkpressure, so that acceleration is smaller than deceleration. Such a difference is compensated for by means of a pick-up valve such as the one described in the above-mentioned patent, said valve providing an extra orifice for the fluid in the operating step, and being closed during the exhaust step. That pick-up valve therefore reduces the loss of head when accelerating; however, it has the drawback of opening abruptly, which, at the moment of starting,, generates a shock resulting from a water-hammer effect by the pump.

Under transient conditions in particular at the moment of starting, acceleration, though high in the beginning, is caused to decrease as soon as the piston moves forward, in view of the fact that the valve loss-of-head increases with the flow-rate, since the flow cross-section of the valve is constant.

The present invention relates to a device adapted to obviate the above-mentioned drawbacks, said device, in addition, being of simple design, and of moderate cost.

In that device, the pick-up valve is no longer provided, and the accelerating step is achieved by means of a ring of the piston acting as non-return flap valve, and adapted to uncover some ports, or orifices, supplemental to those for deceleration, and situated in the same portion of the jack stroke, thus making up for the above-mentioned flow-rate difference. More specifically, the initial stroke accelerating device, according to the invention, applies to a jack comprising a cylinder provided with stages of calibrated fluid feed or exhaust ports, and a piston provided with sealing rings, characterized in that at least one end ring is mounted with a certain axial and lateral clearance in its groove, the latter communicating with the piston bottom through at least one port.

An embodiment of the invention will now be described with reference to the accompanying drawing, in which FIG. 1 is an axial cross-section of an accelerating and decelerating device, shown at the end of the decelerating step;

FIG. 2 shows the same device, in the accelerating step, prior to the operation thereof, and FIG. 3 shows the device of FIG. 2, after a slight motion.

The device shown in FIG. 1 comprises a jack casing C, in which is slidable a piston P provided with four piston-rings $S_1$ to $S_4$, of which end rings $S_1$ and $S_4$ are mounted in their respective grooves with a certain amount of lateral and axial clearance. Jack end member F accomodates a needle point-screw V for adjusting the speed of the piston end stroke.

In operation, during the decelerating step, ring $S_1$ bears on its right-hand sides, while ring $S_4$ bears on its left-hand sides under the action of respectively feed pressure $P_1$ against the bias of damping pressure $P_2$.

Deceleration is achieved by obstructing ports in the cylinder casing wall $T_8$, $T_7$ in succession, down to port $T_2$, so as to end with a uniform speed depending on the exhaust flow-rate of the point of screw V.

During the accelerating step, as shown in FIGS. 2 and 3, piston-ring $S_1$ will rest on its left-hand side (FIG. 3), in view of the piston rightwards motion under the action of feed pressure $P_3$, and of the difference between the feed crosssections of the port controlled by needle point-screw V, on the one hand, and of ports $T_2$ situated between piston-rings $S_1$ and $S_2$, on the other hand.

During acceleration, a certain amount of fluid flows through those ports situated, at any moment, between rings $S_1$ and $S_2$, then flows past the bottom of ring $S_1$ and through ports $B_1$ made in groove $R_1$.

The overall flow-rate is increased during the piston motion, in view of the fact these ports to the left-hand side of the piston are uncovered. In practice, deceleration is achieved by making use of all these ports situated to the left of $S_1$, and acceleration by using all the ports situated to the left of $S_2$.

The operation is the same, at the opposite end, with respect to piston-rings $S_3$ and $S_4$.

The shock resulting, at the moment of starting, from a water-hammer effect by the pump no longer exists, in view of the fact that the cross-section, when starting the jack, is but the cross-section of needle point-screw V, and piston-ring $S_1$ has not yet had the time to come to rest along its left-hand side so as to provide an extra flow via ports $B_1$ in the recessed annular end of piston P, as illustrated in FIGS. 2 and 3.

Thus, according to the invention, a simple machining operation and changes in the mounting of such important members as the piston-rings will be sufficient for providing the operational equivalent of the pick-up valve of known devices; moreover, the drawback of a water-hammer effect at the moment of starting is obviated.

What is claimed is:

1. A device for controlling the acceleration and deceleration strokes of a hydraulic cylinder, comprising a cylinder having a casing defining a bore and end members surrounding end portions of the casing and closing the bore, a piston slidably mounted in the casing bore and having end parts, a side wall interconnecting the end parts, and peripheral grooves in its side wall near both end parts, sealing rings positioned in said grooves, at least one radial port formed in each piston end part, a damping chamber formed at each end of the cylinder casing between each cylinder casing end member and piston end part, a fluid conduit means for feeding and exhausting fluid from each of said damping chambers and said cylinder casing, fluid feed and exhaust orifices in the surrounded end portions of the cylinder casing forming a plurality of axially distributed calibrated ports arranged in rows in the cylinder casing at both ends thereof, annular fluid feed chambers formed between the surrounded ends of the casing and the end members and communicating with outer ends of said plurality of calibrated ports, the annular fluid feed chambers communicating with said fluid conduit means, orifice sections formed in both of the cylinder end members for communication between one of the annular fluid feed chambers and one of said damping chambers, and needle point screws positioned in each of said orifice sections for controlling the size of said orifice sections, at least one of said sealing rings at each end of said piston being mounted in its respective groove with a certain amount of axial and lateral clearance, wherein said groove has one side communicating with one of said damping chambers through the at least one radial port in the piston end part and is adapted during movement of the piston to communicate successively at the opposite open side of the groove with the plurality of axially distributed calibrated ports in said cylinder casing thereby varying the size of the opening connecting said annular fluid feed chambers with respective ones of said damping chambers.

2. A device as claimed in claim 1 wherein said at least one of said sealing rings at each end of said piston is movable into a position preventing fluid flow between said plurality of axially distributed calibrated ports, said annular fluid chambers and respective ones of said damping chambers.

* * * * *